US008202335B2

(12) United States Patent
Cooley et al.

(10) Patent No.: US 8,202,335 B2
(45) Date of Patent: Jun. 19, 2012

(54) SUPERABRASIVE ELEMENTS, METHODS OF MANUFACTURING, AND DRILL BITS INCLUDING SAME

(75) Inventors: Craig H. Cooley, Saratoga Springs, UT (US); Kenneth E. Bertagnolli, Riverton, UT (US); Michael A. Vail, Genola, UT (US)

(73) Assignee: US Synthetic Corporation, Orem, UT (US)

( * ) Notice: Subject to any disclaimer, the term of this patent is extended or adjusted under 35 U.S.C. 154(b) by 1274 days.

(21) Appl. No.: 11/899,691

(22) Filed: Sep. 7, 2007

(65) Prior Publication Data

US 2008/0085407 A1 Apr. 10, 2008

Related U.S. Application Data

(60) Provisional application No. 60/850,969, filed on Oct. 10, 2006.

(51) Int. Cl.

| | |
|---|---|
| ***B21K 5/02*** | (2006.01) |
| ***B21K 5/04*** | (2006.01) |
| ***B24D 18/00*** | (2006.01) |
| ***B24D 3/00*** | (2006.01) |
| ***B24D 3/02*** | (2006.01) |
| ***B24D 3/04*** | (2006.01) |
| ***E21B 10/36*** | (2006.01) |
| ***E21B 10/46*** | (2006.01) |

(52) U.S. Cl. ..... 51/307; 51/293; 51/295; 76/108.2; 175/426; 175/434; 175/435

(58) Field of Classification Search ..... None
See application file for complete search history.

(56) References Cited

U.S. PATENT DOCUMENTS

| | | | | |
|---|---|---|---|---|
| 3,745,623 | A | | 7/1973 | Wentorf, Jr. et al. |
| 4,224,380 | A | * | 9/1980 | Bovenkerk et al. ..... 428/545 |
| 4,268,276 | A | | 5/1981 | Bovenkerk |
| 4,333,902 | A | | 6/1982 | Hara |
| 4,410,054 | A | | 10/1983 | Nagel et al. |
| 4,468,138 | A | | 8/1984 | Nagel |
| 4,560,014 | A | | 12/1985 | Geczy |
| 4,738,322 | A | | 4/1988 | Hall et al. |
| 4,811,801 | A | | 3/1989 | Salesky et al. |
| 4,913,247 | A | | 4/1990 | Jones |
| 5,016,718 | A | | 5/1991 | Tandberg |
| 5,092,687 | A | | 3/1992 | Hall |

(Continued)

FOREIGN PATENT DOCUMENTS

EP 0352811 A1 1/1990

(Continued)

OTHER PUBLICATIONS

PCT International Search Report and Written Opinion; International Application No. PCT/US2007/021464, International Filing Date Oct. 5, 2007.

(Continued)

*Primary Examiner* — Melvin C Mayes
*Assistant Examiner* — Colin W Slifka
(74) *Attorney, Agent, or Firm* — Workman Nydegger

(57) ABSTRACT

Methods of manufacturing a superabrasive element and/or compact are disclosed. In one embodiment, a superabrasive volume including a tungsten carbide layer may be formed. Polycrystalline diamond elements and/or compacts are disclosed. Rotary drill bits for drilling a subterranean formation and including at least one superabrasive element and/or compact are also disclosed.

14 Claims, 10 Drawing Sheets

U.S. PATENT DOCUMENTS

| | | | | |
|---|---|---|---|---|
| 5,120,327 | A | 6/1992 | Dennis | |
| 5,135,061 | A | 8/1992 | Newton, Jr. | |
| 5,154,245 | A | 10/1992 | Waldenstrom et al. | |
| 5,364,192 | A | 11/1994 | Damm et al. | |
| 5,368,398 | A | 11/1994 | Damm et al. | |
| 5,370,944 | A * | 12/1994 | Omori et al. | 428/565 |
| 5,460,233 | A | 10/1995 | Meany et al. | |
| 5,480,233 | A | 1/1996 | Cunningham | |
| 5,544,713 | A | 8/1996 | Dennis | |
| 5,952,102 | A * | 9/1999 | Cutler | 428/408 |
| 6,524,357 | B2 * | 2/2003 | Baldoni et al. | 51/297 |
| 6,793,861 | B2 | 9/2004 | McBain et al. | |
| 6,800,383 | B1 | 10/2004 | Lakhotkin et al. | |
| 6,890,655 | B2 * | 5/2005 | Liu et al. | 428/408 |
| 7,022,403 | B1 | 4/2006 | Lakhotkin et al. | |
| 7,060,641 | B2 | 6/2006 | Quian et al. | |
| 7,166,371 | B2 | 1/2007 | Lakhotkin et al. | |
| 7,604,073 | B2 | 10/2009 | Cooley et al. | |
| 2006/0157286 | A1 | 7/2006 | Pope | |
| 2006/0266558 | A1 * | 11/2006 | Middlemiss et al. | 175/426 |

FOREIGN PATENT DOCUMENTS

| | | | |
|---|---|---|---|
| GB | 2362655 | A | 11/2001 |

OTHER PUBLICATIONS

U.S. Appl. No. 60/850,969, filed Oct. 10, 2006, Cooley, et al.
U.S. Appl. No. 10/654,512, filed Sep. 3, 2010, Hall.
U.S. Appl. No. 11/545,929, filed Oct. 10, 2006, Bertagnolli, et al.

* cited by examiner

SUPERABRASIVE ELEMENTS, METHODS OF MANUFACTURING, AND DRILL BITS INCLUDING SAME

CLAIM OF PRIORITY

This application claims priority from U.S. Provisional Application Ser. No. 60/850,969 filed on Oct. 10, 2006, which is incorporated herein, in its entirety, by this reference.

BACKGROUND

Wear-resistant compacts comprising superabrasive (i.e., superhard) material are utilized for a variety of applications and in a corresponding variety of mechanical systems. For example, wear resistant superabrasive elements are used in drilling tools (e.g., inserts, cutting elements, gage trimmers, etc.), machining equipment, bearing apparatuses, wire drawing machinery, and in other mechanical systems.

In one particular example, polycrystalline diamond compacts have found particular utility as cutting elements in drill bits (e.g., roller cone drill bits and fixed cutter drill bits) and as bearing surfaces in so-called "thrust-bearing" apparatuses. A polycrystalline diamond compact ("PDC") cutting element or cutter typically includes a diamond layer or table formed by a sintering process employing high-temperature and high-pressure conditions that causes the diamond table to become bonded to a substrate (e.g., a cemented tungsten carbide substrate), as described in greater detail below.

When a polycrystalline diamond compact is used as a cutting element, it may be mounted to a drill bit either by press-fitting, brazing, or otherwise coupling the cutting element into a receptacle defined by the drill bit, or by brazing the substrate of the cutting element directly into a preformed pocket, socket, or other receptacle formed in the drill bit. In one example, cutter pockets may be formed in the face of a matrix-type bit comprising tungsten carbide particles that are infiltrated or cast with a binder (e.g., a copper-based binder), as known in the art. Such drill bits are typically used for rock drilling, machining of wear resistant materials, and other operations which require high abrasion resistance or wear resistance. Generally, a rotary drill bit may include a plurality of polycrystalline abrasive cutting elements affixed to a drill bit body.

A PDC (as well as other superhard materials) may be fabricated by placing a layer of diamond crystals or grains adjacent one surface of a substrate and exposing the diamond grains and substrate to an ultra-high pressure and ultra-high temperature ("HPHT") process. Thus, a substrate and adjacent diamond crystal layer may be sintered under ultra-high temperature and ultra-high pressure conditions to cause the diamond crystals or grains to bond to one another. In addition, as known in the art, a catalyst may be employed for facilitating formation of polycrystalline diamond. In one example, a so-called "solvent catalyst" may be employed for facilitating the formation of polycrystalline diamond. For example, cobalt, nickel, and iron are among examples of solvent catalysts for forming polycrystalline diamond. In one configuration, during sintering, solvent catalyst from the substrate body (e.g., cobalt from a cobalt-cemented tungsten carbide substrate) becomes liquid and sweeps from the region behind the substrate surface next to the diamond powder and into the diamond grains. Of course, a solvent catalyst may be mixed with the diamond powder prior to sintering, if desired.

Also, as known in the art, such a solvent catalyst may dissolve carbon at high temperatures. Such carbon may be dissolved from the diamond grains or portions of the diamond grains that graphitize due to the high temperatures of sintering. When the solvent catalyst is cooled, at least a portion of the carbon held in solution may precipitate or otherwise be expelled from the solvent catalyst and may facilitate formation of diamond bonds between adjacent or abutting diamond grains. Thus, the diamond grains become mutually bonded to form a polycrystalline diamond table upon the substrate. The solvent catalyst may remain in the diamond layer within the interstitial space between the diamond grains or the solvent catalyst may be at least partially removed and optionally replaced by another material, as known in the art. For instance, the solvent catalyst may be at least partially removed from the polycrystalline diamond by acid leaching. One example of a conventional process for forming polycrystalline diamond compacts is disclosed in U.S. Pat. No. 3,745,623 to Wentorf, Jr. et al., the disclosure of which is incorporated herein, in its entirety, by this reference. Superhard materials (other than polycrystalline diamond) may also be formed by HPHT processing (i.e., sintering) or may be formed by other processes (e.g., chemical vapor deposition or any other suitable process), without limitation.

It may be appreciated that it would be advantageous to provide methods for forming superabrasive materials and apparatuses, structures, or articles of manufacture including such superabrasive material.

SUMMARY

One aspect of the instant disclosure relates to a superabrasive volume including a tungsten carbide layer. Such a superabrasive volume may comprise polycrystalline diamond, cubic boron nitride, diamond, silicon carbide, mixtures of the foregoing, or any composite including one or more of the foregoing materials and/or other superhard materials. Further, a tungsten carbide layer may be formed upon at least a portion of superabrasive volume. For example, a tungsten carbide layer may be formed upon at least a portion of a substantially planar surface and/or a side surface of the superabrasive volume. Optionally, such a superabrasive volume may be affixed to a substrate or to a drilling tool. For example, a superabrasive element/compact including tungsten carbide layer may be affixed to a drill bit or other drilling tool by brazing or any other suitable method.

Any of the aspects described in this application may be applicable to a polycrystalline diamond element or method of forming or manufacturing a polycrystalline diamond element.

Subterranean drill bits or other subterranean drilling or reaming tools including at least one of any superabrasive element encompassed by this application are also contemplated by the present invention.

Features from any of the above mentioned embodiments may be used in combination with one another, without limitation. In addition, other features and advantages of the instant disclosure will become apparent to those of ordinary skill in the art through consideration of the ensuing description, the accompanying drawings, and the appended claims.

BRIEF DESCRIPTION OF THE DRAWINGS

Further features of the subject matter of the instant disclosure, its nature, and various advantages will be more apparent from the following detailed description and the accompanying drawings, which illustrate various exemplary embodiments, are representations, and are not necessarily drawn to scale, wherein.

DETAILED DESCRIPTION

Figure 1A:
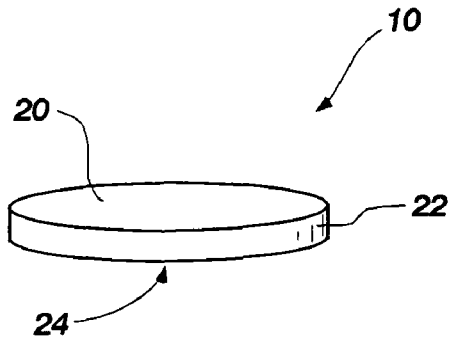
FIG. 1A shows a perspective view of one embodiment of a superabrasive volume.

The present invention relates generally to structures comprising at least one superabrasive material (e.g., diamond, boron nitride, silicon carbide, mixtures of the foregoing, or any material exhibiting a hardness exceeding a hardness of tungsten carbide) and methods of manufacturing such structures. Exemplary embodiments and features relating to the present invention are discussed hereinbelow.

The terms "superhard" and "superabrasive," as used herein, mean a material exhibiting a hardness exceeding a hardness of tungsten carbide. For example, polycrystalline diamond may be one embodiment of a superabrasive volume. In another example, superabrasive material comprising a diamond-silicon carbide composite as disclosed in U.S. Pat. No. 7,060,641, the disclosure of which is incorporated herein, in its entirety, by this reference may be employed to form a superabrasive volume. More generally, cubic boron nitride, diamond, silicon carbide, or mixtures or any composite including one or more of the foregoing materials or other superhard materials may be employed.

More particularly, the present invention relates to a superabrasive mass or volume with a tungsten carbide layer. As used herein, the phrase "tungsten carbide layer" means a material substantially comprising tungsten carbide (which may be alloyed to a limited extent), wherein the tungsten carbide is not cemented or held in a binder or matrix. In one embodiment, a tungsten carbide layer may essentially consist of tungsten carbide or may consist entirely of tungsten carbide. Thus, explaining further, a tungsten carbide layer may be formed, for instance, by chemical vapor deposition, physical vapor deposition, chemical reactions, sintering (without a binder), or any suitable method. Accordingly, a cobalt-cemented tungsten carbide material or a tungsten carbide hardfacing (tungsten carbide particulate applied to a surface with a melted binder) material is not considered a tungsten carbide layer according to the above definition.

In one embodiment of a method of manufacturing a superabrasive element, a superabrasive volume including a tungsten carbide layer may be formed. Further, the superabrasive volume and a substrate may be bonded to one another. Such a method may be employed to form a superabrasive element with desirable characteristics. For instance, in one embodiment, such a process may allow for bonding of a so-called "thermally-stable" product ("TSP") or thermally-stable polycrystalline diamond ("TSD") or a partially thermally-stable (i.e., partially leached) polycrystalline diamond volume to a substrate to form a polycrystalline diamond element. In one embodiment, a HPHT process may be employed for bonding the polycrystalline diamond volume to the substrate. Such a polycrystalline diamond element may exhibit a desirable residual stress field and desirable thermal stability characteristics.

As described above, manufacturing sintered superabrasive materials, such as polycrystalline diamond involves the compression of superhard particles under extremely high pressure. Such compression may occur at room temperature, at least initially, and may result in the reduction of void space in the superhard particles due to brittle crushing, sliding, stacking, and/or otherwise consolidation. Thus, the superhard particles may sustain very high local pressures where they contact one another, but the pressures experienced on non-contacting surfaces of the superhard particles and in the interstitial voids may be, comparatively, low. Manufacturing superhard materials further involves heating the superhard particles. Such heating may increase the temperature of the superhard particles from room temperature to facilitate inter-particle bonding (i.e., to a temperature and pressure where the desired superhard material is thermodynamically stable).

In the case of polycrystalline diamond, heating of diamond particles to at least to the melting point of a solvent catalyst is typically desired. Portions of the diamond particles under high local pressures may remain diamond, even at elevated temperatures. However, regions of the diamond particles that are not under high local pressure may begin to graphitize as temperature of such regions increases. Further, as a solvent-catalyst melts, it may infiltrate or "sweep" through the diamond particles. In addition, as known in the art, a solvent catalyst (e.g., cobalt, nickel, iron, etc.) may dissolve and transport carbon between the diamond grains and facilitate diamond formation. Thus, the presence of solvent catalyst may facilitate the formation of diamond-to-diamond bonds in the sintered polycrystalline diamond material, resulting in formation of a coherent skeleton or matrix of bonded diamond particles or grains. Other types of catalysts besides metal solvent catalysts may be employed. For example, carbonate-based catalysts (e.g., magnesium carbonate ($MgCO_3$)), may be used to promote diamond-to-diamond bonds in the sintered polycrystalline diamond material.

One aspect of the present invention relates to a superabrasive volume including a tungsten carbide layer. More particularly, the present invention contemplates that one embodiment of a method of manufacturing a superabrasive compact may comprise forming a superabrasive volume including a tungsten carbide layer over at least a portion of an exterior surface of the superabrasive volume. In one embodiment, a tungsten carbide layer may be formed by chemical vapor deposition ("CVD") or variants thereof (e.g., plasma-enhanced CVD, etc., without limitation). Specifically, for example, one example of a commercially available CVD tungsten carbide layer (currently marketed under the trademark HARDIDE®) is currently available from Hardide Layers Inc. of Houston, Tex. In other embodiments, a tungsten carbide layer may be formed by physical vapor deposition ("PVD"), variants of PVD, high-velocity oxygen fuel ("HVOF") thermal spray processes, or any other suitable process, without limitation.

One of ordinary skill in the art will recognize that in some embodiments, the tungsten carbide layer may be formed prior to forming the superabrasive volume. For example, a tungsten carbide sheet or film may be positioned adjacent to a superabrasive powder (e.g., diamond powder, cubic boron nitride powder, silicon carbide powder, mixtures of the foregoing, etc.) and then the superabrasive powder may be sintered to form a superabrasive volume. In another example, a tungsten carbide layer may be initially formed and a superabrasive volume may be formed upon the tungsten carbide layer by CVD or any other suitable process.

Figure 1B:
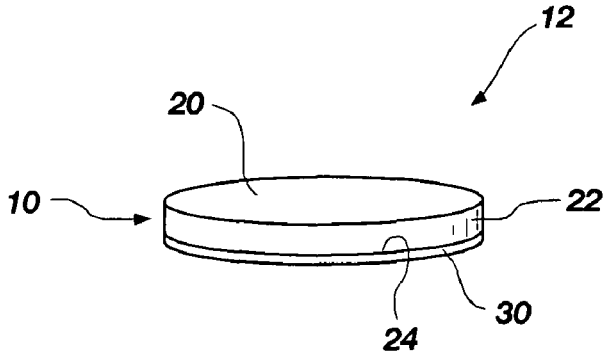
FIG. 1B shows a perspective view of a superabrasive element comprising the superabrasive volume shown in FIG. 1A including a tungsten carbide layer.

More particularly, FIG. 1A shows a perspective view of one embodiment of a superabrasive volume 10. As shown in FIG. 1A, in one embodiment, superabrasive volume 10 may be generally cylindrical and may include upper substantially planar surface 20, side surface 22, and lower substantially planar surface 24. Further, as discussed above, superabrasive volume 10 may comprise polycrystalline diamond, cubic boron nitride, diamond, silicon carbide, mixtures of the foregoing, or any composite including one or more of the foregoing materials and/or other superhard materials. Additionally, a tungsten carbide layer may be formed upon at least a portion of superabrasive volume 10. For example, FIG. 1B shows one embodiment of a superabrasive element 12 including a tungsten carbide layer 30 formed upon at least a portion of substantially planar surface 24. Tungsten carbide layer 30 may exhibit a thickness of about 5 μm to about 100 μm, and more specifically about 5 μm to about 60 μm. Such a configuration may allow for superabrasive element 52 to be attached to a drilling tool or other apparatus. For example, superabrasive element 52 including tungsten carbide layer 30 may be affixed to a drill bit by brazing, since the tungsten carbide layer 30 may be wettable by a brazing alloy.

More generally, the present invention contemplates that tungsten carbide layer 30 may be formed upon any portion of substantially planar surface 24 and/or any portion of side surface 22 and/or any portion of substantially planar surface 20, without limitation. Explaining further, any portion over which a tungsten carbide layer is not desired may be masked or otherwise precluded from forming the tungsten carbide layer. In another embodiment, tungsten carbide may be formed over a selected region (e.g., the entire exterior or a portion thereof) of the superabrasive volume 10 and then selected portions of such tungsten carbide layer may be removed by grinding, electrical-discharge machining, chemical treatments, or any other suitable method, without limitation.

Figure 2A:
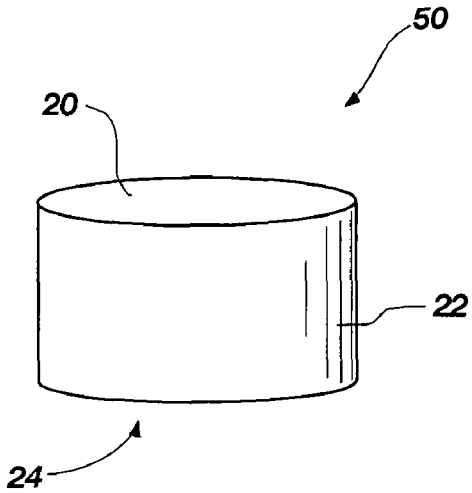
FIG. 2A shows a perspective view of another embodiment of a superabrasive volume.
Figure 2B:
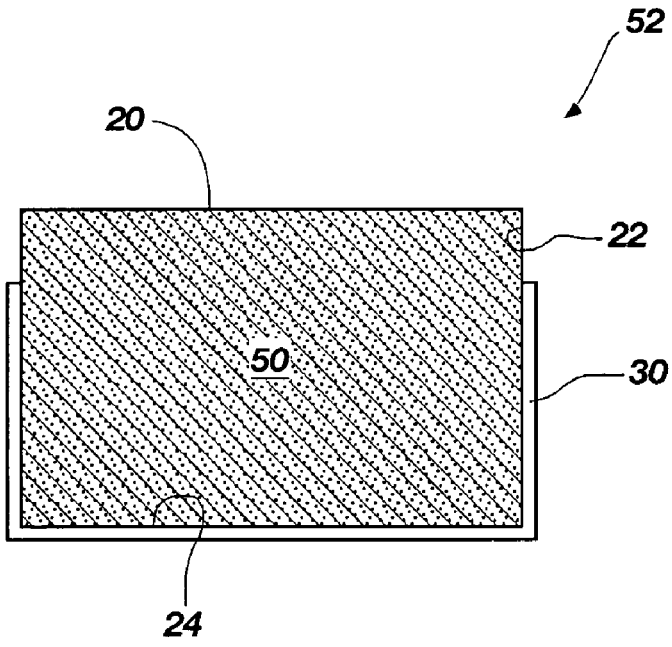
FIG. 2B shows a side cross-sectional view of a superabrasive element comprising the superabrasive volume shown in FIG. 2A including a tungsten carbide layer.

FIG. 2A shows another embodiment of a superabrasive volume 50 including an upper substantially planar surface 20, a side surface 22, and a lower substantially planar surface 24. As shown in FIG. 2A, superabrasive volume 50 may be substantially cylindrical, in one embodiment. Further, a tungsten carbide layer may be formed upon at least a portion of superabrasive volume 50. For example, FIG. 2B shows one embodiment of a superabrasive element 52 including a tungsten carbide layer 30 formed upon substantially planar surface 24 and over a majority of side surface 22. Such a configuration may allow for superabrasive element 52 to be attached to a drilling tool or other apparatus. For example, superabrasive element 52 may be affixed to a drill bit by brazing, since the tungsten carbide layer 30 may be wet by a brazing alloy. More generally, the present invention contemplates that tungsten carbide layer 30 may be formed upon any portion of substantially planar surface 24 and/or any portion of side surface 22 and/or any portion of substantially planar surface 20, without limitation. As described above, tungsten carbide layer 30 may be formed over a selected portion of superabrasive volume 30 via masking, selective removal, or any other suitable method.

One of ordinary skill in the art will understand that the instant disclosure contemplates a tungsten carbide layer bonded to a superabrasive material. The instant disclosure contemplates that such a tungsten carbide layer may be bonded directly to a superabrasive material or one or more intermediary layer may extend between the superabrasive material and the tungsten carbide layer. For example, an intermediary layer between the superabrasive material and the tungsten carbide layer may comprise tungsten, cobalt, molybdenum, tin, copper, or any metal, ceramic, or other selected material. Further, a tungsten carbide layer may include other constituents, such as an alloying material or other element or compound. For example, tungsten carbide may be alloyed with fluorine. In another example, alternate layers of tungsten and tungsten carbide may be formed. Of course, additional layers of a selected material may be formed upon a tungsten carbide layer, if desired.

Further, optionally, a method of manufacturing a superabrasive compact may further comprise affixing a superabrasive volume including a tungsten carbide layer to a substrate. For example, a superabrasive volume may be brazed, soldered, welded (including frictional or inertial welding), or otherwise affixed to a substrate. In another embodiment, the superabrasive volume may become affixed to a substrate by exposing the superabrasive volume and substrate to an elevated pressure (i.e., any pressure exceeding an ambient atmospheric pressure; e.g., exceeding about 20 kilobar, at least about 60 kilobar, or between about 20 kilobar and about 60 kilobar) and an elevated temperature (e.g., at least about 1000° Celsius). Generally, any method of affixing the superabrasive volume to the substrate may be employed.

In one embodiment, subsequent to forming the superabrasive volume including a tungsten carbide layer, the superabrasive element may be positioned adjacent to a substrate, and the superabrasive element and the substrate may be subjected to a HPHT process. As discussed above, a HPHT process includes developing an elevated pressure and an elevated temperature. As used herein, the phrase "HPHT process" means to generate a pressure of at least about 40 kilobar and a temperature of at least about 1000° Celsius. In one example, a pressure of at least about 60 kilobar may be developed. Regarding temperature, in one example, a temperature of at least about 1,350° Celsius may be developed. Further, such a HPHT process may cause the superabrasive element to become affixed to the substrate. Optionally, a braze material may be provided to ultimately extend between and affix the superabrasive element and the substrate to one another. Such a braze material may be at least partially melted to affix the superabrasive element to the substrate upon cooling of the braze material.

Figure 3:
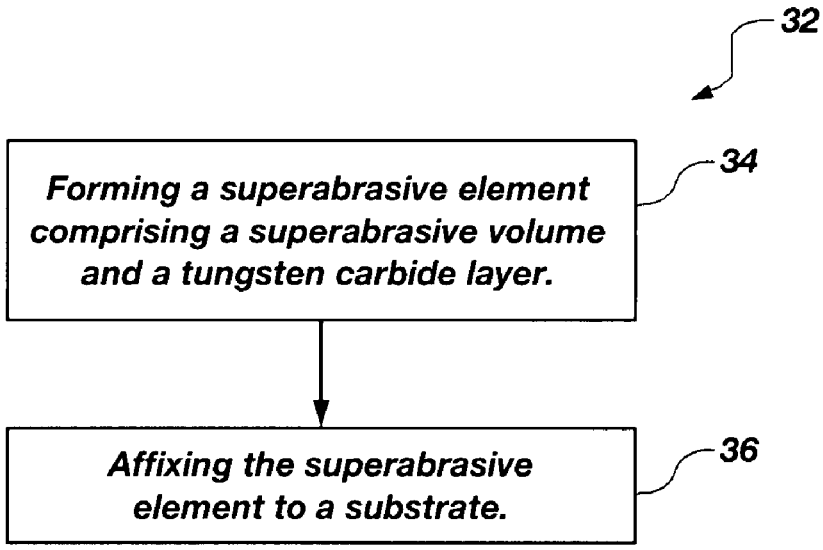
FIG. 3 shows a schematic diagram of one embodiment of a method for forming a superabrasive compact encompassed by the present invention.

One aspect of the present invention relates to a manufacturing method for forming a superabrasive compact. Generally, a manufacturing method for forming a superabrasive compact may include forming a superabrasive element comprising a superabrasive volume and a tungsten carbide layer. Further, the superabrasive element may be affixed to a substrate. FIG. 3 shows a schematic diagram of a method 32 for forming a superabrasive compact. As shown in FIG. 3, method 32 comprises process action 34 and process action 36. Particularly, as shown in FIG. 3, a superabrasive element may be provided (as represented by process action 34 in FIG. 3) by forming superabrasive volume including a tungsten carbide layer. Further, the superabrasive element may be affixed to a substrate (as represented by process action 36 in FIG. 3) to form a superabrasive compact.

For example, a superabrasive element comprising a superabrasive volume including a tungsten carbide layer may be positioned adjacent to a substrate and the assembly may be exposed to a HPHT process. Optionally, during the HPHT process, at least one constituent (e.g., a metal) of the substrate and/or the superabrasive element may at least partially melt. Further, upon cooling, the superabrasive element may be affixed to the substrate. Optionally, such a HPHT process may generate a beneficial residual stress field within each of the superabrasive volume and the substrate. Explaining further, a coefficient of thermal expansion of a superabrasive material may be substantially less than a coefficient of expansion of a substrate. In one example, a superabrasive volume may comprise polycrystalline diamond and a substrate may comprise cobalt-cemented tungsten carbide. The present invention contemplates that selectively controlling the temperature and/or pressure during a HPHT process may allow for selectively tailoring a residual stress field developed within a superabrasive volume and/or a substrate to which the superabrasive volume is affixed. Furthermore, the presence of a residual stress field developed within the superabrasive and/or the substrate may be beneficial.

Figure 4:
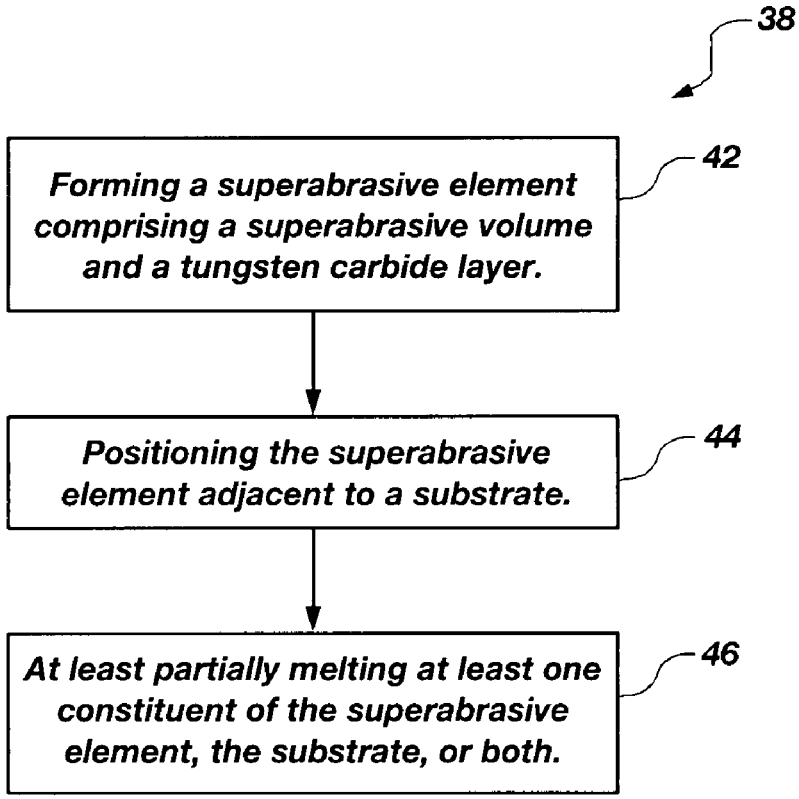
FIG. 4 shows a schematic diagram of an additional embodiment of a method for forming a superabrasive compact.

FIG. 4 shows a schematic diagram representing another embodiment of a method 38 for forming a superabrasive compact, the method comprising a process action 42 and a process action 46. As shown in FIG. 4, process action 42 may include forming a superabrasive element comprising a superabrasive volume and a tungsten carbide layer. In addition, as represented by process action 44, the superabrasive element may be positioned adjacent to a substrate. Further, at least one constituent of the superabrasive element, the substrate, or both may be at least partially melted (as represented by process action 46). At least partially melting of such at least one constituent may cause the superabrasive element to be affixed or bonded to the substrate. Such a method 38 may be relatively effective for bonding a superabrasive element to a substrate.

Explaining further, at least one constituent of a substrate, at least one constituent of a superabrasive volume or a combination of the foregoing may be employed to affix the superabrasive volume to the substrate. In one embodiment, a superabrasive volume may comprise a sintered structure formed by a previous HPHT process. For example, a superabrasive volume may comprise a polycrystalline diamond structure (e.g., a diamond table) or any other sintered superabrasive material, without limitation. In other embodiments, superabrasive volume may comprise boron nitride, silicon carbide, fullerenes, or a material having a hardness exceeding a hardness of tungsten carbide, without limitation. In one example, a substrate may comprise a cobalt-cemented tungsten carbide. Accordingly, at elevated temperatures and pressures, such cobalt may at least partially melt and/or infiltrate or wet the superabrasive volume. Upon solidification of the cobalt, the substrate and the superabrasive volume may be affixed to one another.

Figure 5:
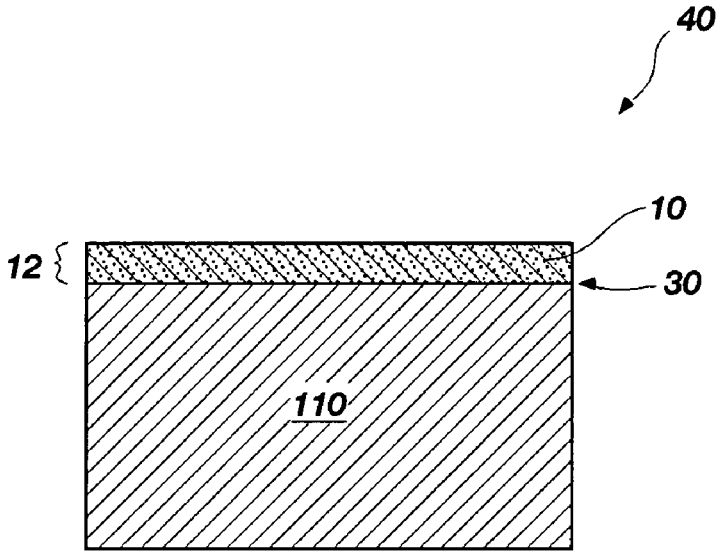
FIG. 5 shows a side cross-sectional view of one embodiment of a superabrasive compact encompassed by the present invention.

FIG. 5 shows a side cross-sectional view of a superabrasive compact 40 comprising a superabrasive element 12, as described herein, bonded to a substrate 110. In one embodiment, superabrasive volume 10 may comprise polycrystalline diamond and a tungsten carbide layer 30, and substrate 110 may comprise a cobalt-cemented tungsten carbide. The present invention further contemplates that if superabrasive volume 10 comprises polycrystalline diamond, a catalyst (e.g., cobalt) used to form the superabrasive volume 10 may be at least partially removed from the polycrystalline diamond. For example, a catalyst (e.g., cobalt) may be at least partially removed from polycrystalline diamond by exposing the polycrystalline diamond to an acid, exposing the polycrystalline diamond to an electrolytic processes, combinations of the foregoing, or any other suitable method.

Figure 6:
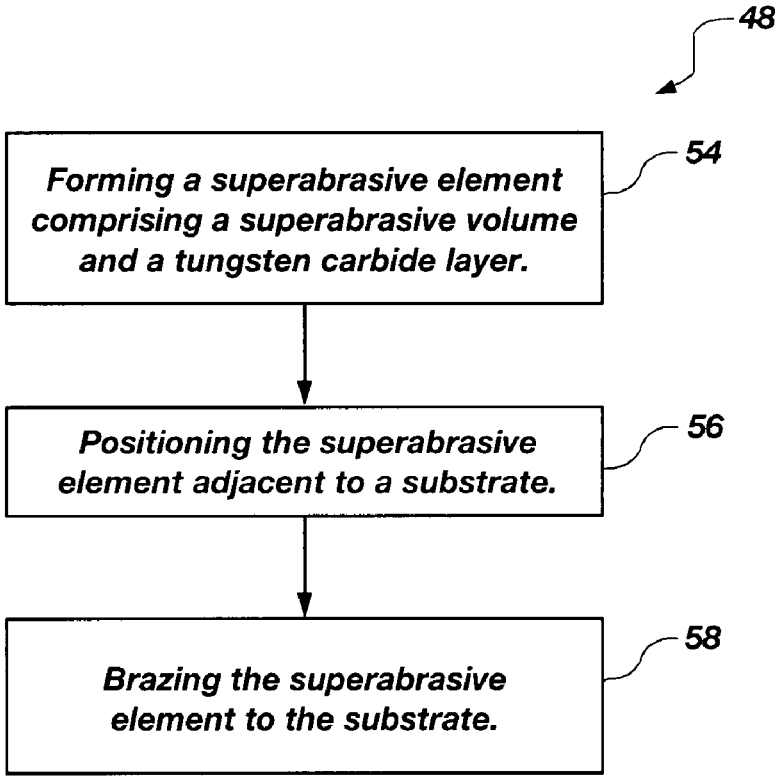
FIG. 6 shows a schematic diagram of a further embodiment of a method for forming a superabrasive compact.

Another aspect of the present invention relates to bonding or affixing a superabrasive volume to a substrate by at least partially melting a braze material. For example, FIG. 6 shows a further embodiment of a manufacturing method 48 for forming a superabrasive element, the method comprising a process action 54, process action 56, and process action 58. As shown in FIG. 6, process action 54 may include forming a superabrasive element comprising a superabrasive volume and a tungsten carbide layer. Further, as represented by process action 56, the superabrasive element and, as represented by process action 58, the superabrasive element may be brazed to the substrate.

Exemplary brazes, in one example, may be referred to as "Group Ib solvents" (e.g., copper, silver, and gold) and may optionally contain one or more carbide former (e.g., titanium, vanadium, chromium, manganese, zirconium, niobium, molybdenum, technetium, hafnium, tantalum, tungsten, or rhenium, without limitation). Accordingly, exemplary compositions may include gold-tantalum Au—Ta, silver-copper-titanium (Ag—Cu—Ti), or any mixture of any Group Ib solvent(s) and, optionally, one or more carbide former. Other suitable braze materials may include a metal from Group VIII in the periodic table, (e.g., iron, cobalt, and nickel). In one embodiment, a braze material may comprise an alloy of about 4.5% titanium, about 26.7% copper, and about 68.8% silver, otherwise known as TICUSIL®, which is currently commercially available from Wesgo Metals, Hayward, Calif. In a further embodiment, a braze material may comprise an alloy of about 25% silver, about 37% copper, about 10% nickel, about 15% palladium, and about 13% manganese, otherwise known as PALNICUROM® 10, which is also currently commercially available from Wesgo Metals, Hayward, Calif. In an additional embodiment, a braze material may comprise an alloy of about 64% iron and about 36% nickel, commonly referred to as Invar. In again a further embodiment, a braze material may comprise a single metal such as for example, cobalt. One of ordinary skill in the art will understand that brazing may be performed in an inert environment (i.e., an environment that inhibits oxidation), which may be a beneficial environment for proper functioning of the braze alloy.

Optionally, a superabrasive volume and at least a portion of a substrate may be sealed within an enclosure under vacuum or an inert atmosphere (e.g., at least substantially surrounded by an inert gas, such as argon, nitrogen, and/or helium, without limitation). Generally, any methods or systems may be employed for sealing, under vacuum or inert atmosphere, a superabrasive volume or element and at least a portion of a substrate within an enclosure. For example, U.S. Pat. No. 4,333,902 to Hara, the disclosure of which is incorporated, in its entirety, by this reference, and U.S. patent application Ser. No. 10/654,512 to Hall, et al., filed 3 Sep. 2003 the disclosure of which is incorporated, in its entirety, by this reference, each disclose methods and systems related to sealing an enclosure under vacuum or inert atmosphere. U.S. patent application Ser. No. 11/545,929, the disclosure of which is incorporated, in its entirety, by this reference also discloses another example of methods and systems for sealing an enclosure in an inert environment.

Accordingly, generally, the present invention contemplates a braze material may be at least partially melted to affix the substrate to the superabrasive element. Subsequent cooling of the braze material may cause solidification of the braze material, and affixation of the superabrasive element to the substrate via the braze material. In one example, a superabrasive element, a braze material, and a substrate may be exposed to a HPHT process. Such a HPHT process may cause the superabrasive element to be affixed to the substrate via the braze material. In another embodiment, a braze material, substrate, and/or superabrasive element may be heated to effect affixation of the superabrasive element and the substrate.

In another example, a superabrasive element, a braze material, and a substrate may be exposed to a pressure exceeding an ambient atmospheric pressure (e.g., at least about 60 kilobar). Further, the braze material may be at least partially melted. Optionally, the braze material may be at least partially melted while the elevated pressure is applied to the enclosure. In one embodiment, a braze material may exhibit a melting temperature of at least about 900° Celsius. For example, in one embodiment, a braze material may exhibit a melting temperature of about 900° Celsius in the case of TICUSIL®). In another embodiment, a braze material may exhibit a melting temperature of about 1013° Celsius in the case of PALNICUROM® 10. In a further embodiment, a braze material may exhibit a melting temperature of about 1427° Celsius in the case of Invar. In yet a further embodiment, a braze material may exhibit a melting temperature of about 1493° Celsius in the case of cobalt. One of ordinary skill in the art will understand that the actual melting temperature of a braze material is dependent on the pressure applied to the braze material and the composition of the braze material. Accordingly, the values listed above are merely for reference. In addition, the braze material may be at least partially solidified while the enclosure is exposed to the selected, elevated pressure (e.g., exceeding about 20 kilobar, at least about 60 kilobar, or between about 20 kilobar and about 60 kilobar). Such a process may affix or bond the superabrasive element to the substrate. Moreover, solidifying the braze material while the enclosure is exposed to an elevated pressure exceeding an ambient atmospheric pressure may develop a selected level of residual stress within the superabrasive element upon cooling to ambient temperatures and upon release of the elevated pressure.

The present invention contemplates that an article of manufacture comprising a superabrasive volume may be manufactured by performing the above-described processes or variants thereof. In one example, apparatuses including polycrystalline diamond may be useful for cutting elements, heat sinks, wire dies, and bearing apparatuses, without limitation. Optionally, a superabrasive volume may comprise polycrystalline diamond. Thus, a polycrystalline diamond volume may be formed by any suitable process, without limitation. Optionally, such a polycrystalline diamond volume may comprise so-called "thermally stable" polycrystalline diamond material. For example, a catalyst material (e.g., cobalt, nickel, iron, or any other catalyst material), which may be used to initially form the polycrystalline diamond volume, may be at least partially removed (e.g., by acid leaching or as otherwise known in the art) from the polycrystalline diamond volume. In one embodiment, a polycrystalline diamond volume that is substantially free of a catalyzing material may be affixed or bonded to a substrate. Such a polycrystalline diamond apparatus may exhibit desirable wear characteristics. In addition, as described above, such a polycrystalline diamond apparatus may exhibit a selected residual stress field that is developed within the polycrystalline diamond volume and/or the substrate.

In a specific example, a polycrystalline diamond element comprising a polycrystalline diamond volume and a tungsten carbide layer may be affixed to a substrate by a braze material. In one example, the polycrystalline diamond element, braze material, and substrate may be exposed to a HPHT process. Such a HPHT process may cause the polycrystalline diamond element to be affixed to the substrate via the braze material, as described above. Furthermore, a polycrystalline diamond element so formed may exhibit the beneficial residual stress characteristics described above. For example, a polycrystalline diamond element, a substrate, and a braze material may be exposed to a pressure exceeding an ambient atmospheric pressure (e.g., exceeding about 20 kilobar, at least about 60 kilobar, or between about 20 kilobar and about 60 kilobar). Further, the braze material may be at least partially melted. Of course, the braze material may be at least partially melted during exposure of the enclosure to an elevated pressure, prior to such exposure, after such exposure, or any combination of the foregoing. In addition, the braze material may be solidified while the enclosure is exposed to a selected, elevated pressure (e.g., exceeding about 20 kilobar, at least about 60 kilobar, or between about 20 kilobar and about 60 kilobar). In other embodiments, the braze material may be solidified prior to such exposure, after such exposure, or any combination of the foregoing. Such a process may affix or bond the preformed polycrystalline diamond element to the substrate. Moreover, solidifying the braze material while the enclosure is exposed to an elevated-pressure may develop a selected level of residual stress within the polycrystalline diamond element (i.e., the polycrystalline diamond volume, the braze material, and/or the substrate) upon cooling to ambient temperatures and upon release of the elevated pressure.

Figure 7:
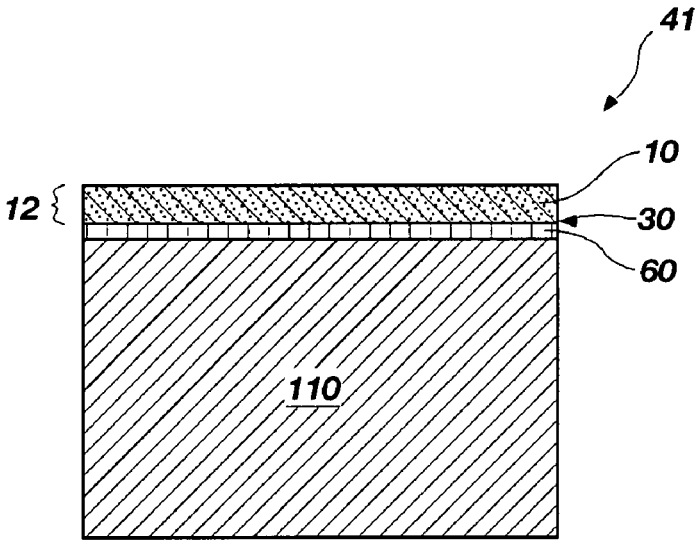
FIG. 7 shows a side cross-sectional view of an additional embodiment of a superabrasive compact encompassed by the present invention.

Thus, as explained above, a superabrasive compact may be formed by any process encompassed by the present invention. FIG. 7 shows a schematic, side cross-sectional view of a superabrasive compact 41 including a superabrasive element 12 (comprising superabrasive volume 10 and tungsten carbide layer 30, which is depicted as a line, for clarity), a substrate 110, and braze material 60. As shown in FIG. 7, braze material 60 may be positioned between the superabrasive element 12 and the substrate 20.

Figure 8:
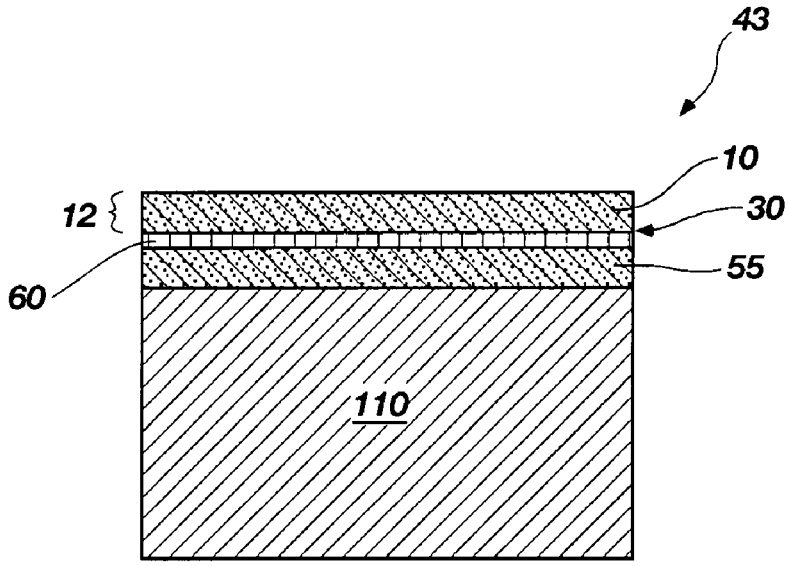
FIG. 8 shows a side cross-sectional view of yet a further embodiment of a superabrasive compact encompassed by the present invention.
Figure 9:
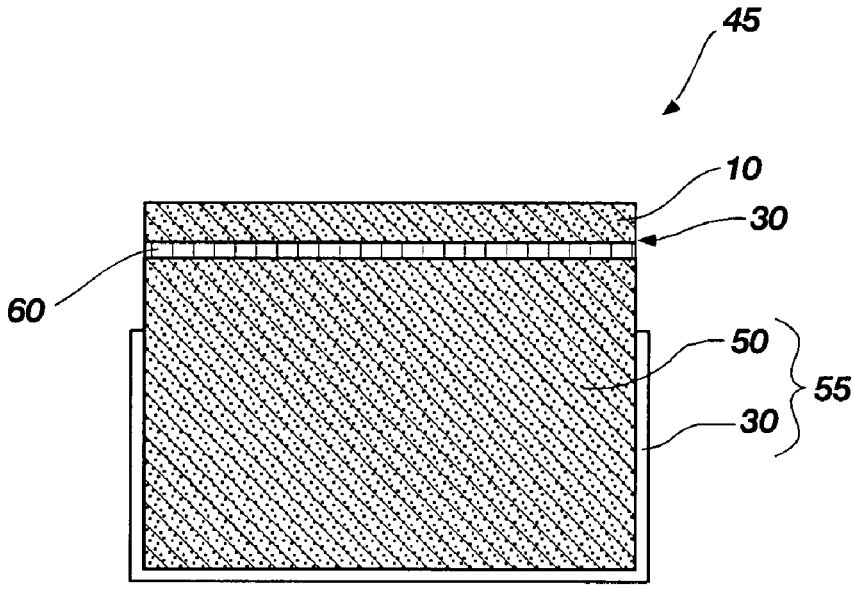
FIG. 9 shows a side cross-sectional view of an additional embodiment of a superabrasive element including a tungsten carbide layer encompassed by the present invention.

In another embodiment, a plurality of superabrasive volumes may be affixed to one another. For example, FIG. 8 shows a schematic, side cross-sectional view of a superabrasive compact 43. As shown in FIG. 8, superabrasive compact 43 comprises a first superabrasive element 12 and a superabrasive volume 55. In one embodiment, a superabrasive volume 55 (e.g., a polycrystalline diamond table) may be formed upon the substrate 110 in a HPHT process. In other embodiments, superabrasive volume 55 may include a tungsten carbide layer and may be affixed to substrate 110 according to the present invention, if desired. As shown in FIG. 8, a braze material 60 may be positioned between superabrasive element 12 (comprising superabrasive volume 10 and tungsten carbide layer 30) and superabrasive volume 55. In a further embodiment, a comparatively thin superabrasive volume may be affixed to a comparatively thicker superabrasive volume. For example, FIG. 9 shows a schematic, side cross-sectional view of a superabrasive element 45. As shown in FIG. 9, superabrasive element 45 comprises a first superabrasive volume 10 and a second superabrasive volume 50. As shown in FIG. 9, a braze material 60 may be positioned between superabrasive volume 10 and superabrasive volume 50. Further, superabrasive volume 50 may include a tungsten carbide layer 30. Thus, superabrasive element 52 (comprising superabrasive volume 50 and tungsten carbide layer 30) may be affixed to superabrasive volume 10.

One of ordinary skill in the art will appreciate from the foregoing exemplary embodiments that many variations and/or configurations (e.g., three or more superabrasive volumes bonded to one another, respectively) for superabrasive structures including a plurality of superabrasive volumes are contemplated by the present invention. More specifically, one of ordinary skill in the art will appreciate that a plurality of superabrasive volumes may be bonded to one another (and, optionally, to a superabrasive compact or other substrate) by appropriately positioning (e.g., stacking) each of the plurality of superabrasive volumes and exposing the enclosure to an increased temperature and/or an elevated pressure, brazing or any suitable method, without limitation. Optionally, at least one superabrasive volume and one or more layers of superabrasive particulate (i.e., powder) may be exposed to elevated pressure and temperature sufficient to sinter the superabrasive particulate and form at least one superabrasive volume.

Figure 10:
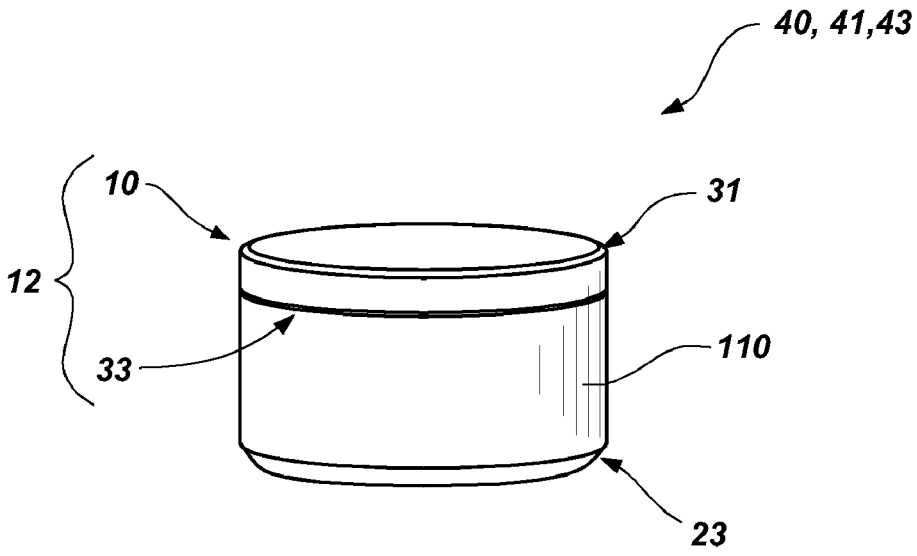
FIG. 10 shows a perspective view of a superabrasive compact encompassed by the present invention.

In one application, the present invention contemplates that a superabrasive volume/element may be affixed to a drilling structure, such as a drill bit. For example, FIG. 10 shows a perspective view of a superabrasive compact 40, 41, and 43. As shown in FIG. 10, substrate 110 may be substantially cylindrical and superabrasive volume 10 may also be substantially cylindrical. As shown in FIG. 10, substrate 110 and superabrasive element 12 may be bonded to one another along an interface 33. Such an interface is defined between substrate 110 and superabrasive element 12 and may exhibit a selected non-planar topography, if desired, without limitation. Further, optionally, a braze material may be positioned between substrate 110 and superabrasive element 12, as discussed above.

Further, a selected superabrasive table edge geometry 31 may be formed upon superabrasive element 12 prior to bonding to substrate 110 or subsequent to bonding of the superabrasive element 12 to the substrate 110. For example, edge geometry 31 may comprise a chamfer, buttress, any other edge geometry, or combinations of the foregoing and may be formed by grinding, electrical-discharge machining, or by other machining or shaping processes. Also, a substrate edge geometry 23 may be formed upon substrate 110 by any machining process or by any other suitable process. Further, such substrate edge geometry 23 may be formed prior to or subsequent to bonding of the superabrasive element 12 to the substrate 110, without limitation. Of course, in one embodiment, the present invention contemplates that superabrasive element 12 may comprise a polycrystalline diamond volume and may be affixed to a substrate 110 comprising a cobalt-cemented tungsten carbide substrate to form a polycrystalline diamond element. For example, such a polycrystalline diamond element may be useful for, for example, cutting processes or bearing surface applications, among other applications.

Figure 11:
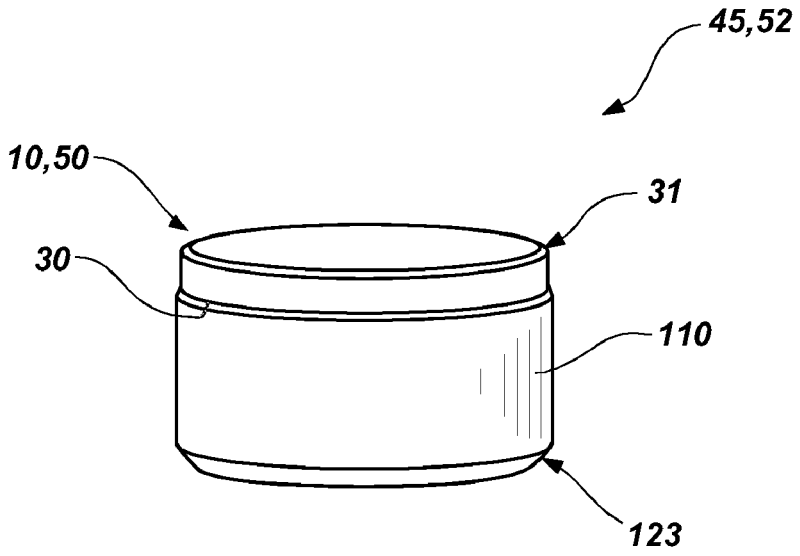
FIG. 11 shows a perspective view of another embodiment of a superabrasive element.

In another embodiment, a superabrasive element may be configured to be affixed to a drilling structure. For example, FIG. 11 shows a perspective view of a superabrasive element 45, 52, as described above. As shown in FIG. 11, superabrasive element 45, 52 may be substantially cylindrical. As also shown in FIG. 11, superabrasive element 45, 52 may include tungsten carbide layer 30. Further, a selected superabrasive table edge geometry 31 may be formed upon superabrasive element volume 10, 50, if desired. For example, edge geometry 31 may comprise a chamfer, buttress, any other edge geometry, or combinations of the foregoing and may be formed by grinding, electrical-discharge machining, or by other machining or shaping processes. Also, edge geometry 123 may be formed upon substrate 110 prior to forming tungsten carbide layer 30 or subsequent to forming tungsten carbide layer 30. Such edge geometry 123 may be formed by any machining process or by any other suitable process. Of course, in one embodiment, the present invention contemplates that superabrasive volume 10, 50 may comprise a polycrystalline diamond volume. Such a polycrystalline diamond element may be useful for, for example, cutting processes or bearing surface applications, among other applications.

The present invention also contemplates that the method and apparatuses discussed above may employ polycrystalline diamond that is initially formed with a catalyst and from which such catalyst is at least partially removed. Explaining further, in one example, during sintering of diamond powder, a catalyst material (e.g., cobalt, nickel, etc.) may be employed for facilitating formation of polycrystalline diamond. More particularly, diamond powder placed adjacent to a cobalt-cemented tungsten carbide substrate and subjected to a HPHT sintering process may wick or sweep molten cobalt into the diamond powder. In other embodiments, catalyst may be provided within the diamond powder, as a layer of material between the substrate and diamond powder, or as otherwise known in the art. In either case, such catalyst (e.g., cobalt) may remain in the polycrystalline diamond table upon sintering and cooling. As also known in the art, such a catalyst material may be at least partially removed (e.g., by acid-leaching or as otherwise known in the art) from at least a portion of the volume of polycrystalline diamond (e.g., a table) formed upon a substrate or otherwise formed. In one embodiment, catalyst removal may be substantially complete to a selected depth from an exterior surface of the polycrystalline diamond table, if desired, without limitation. Such catalyst removal may provide a polycrystalline diamond material with increased thermal stability, which may also beneficially affect the wear resistance of the polycrystalline diamond material.

More particularly, relative to the above-discussed methods and superabrasive elements, the present invention contemplates that a superabrasive volume may be at least partially depleted of catalyst material. In one embodiment, a superabrasive volume may be at least partially depleted of a catalyst material prior to bonding to a substrate. In another embodiment, a superabrasive volume may be bonded to a substrate by any of the methods (or variants thereof) discussed above and, subsequently, a catalyst material may be at least partially removed from the superabrasive volume. In either case, for example, a preformed polycrystalline diamond volume may initially include cobalt that may be subsequently at least partially removed (optionally, substantially all of the cobalt may be removed) from the polycrystalline diamond volume (e.g., by an acid leaching process or any other process, without limitation).

One of ordinary skill in the art will understand that superabrasive materials, compacts, and/or elements may be utilized in many applications. For instance, wire dies, bearings, artificial joints, inserts, cutting elements, and heat sinks may include polycrystalline diamond. Thus, the present invention contemplates that any of the methods encompassed by the above-discussion related to forming superabrasive element may be employed for forming an article of manufacture comprising polycrystalline diamond. As mentioned above, in one example, an article of manufacture may comprise polycrystalline diamond. In one embodiment, the present invention contemplates that a volume of polycrystalline diamond may be affixed to a substrate.

Some examples of articles of manufacture comprising polycrystalline diamond are disclosed by, inter alia, U.S. Pat. Nos. 4,811,801, 4,268,276, 4,410,054, 4,468,138, 4,560,014, 4,738,322, 4,913,247, 5,016,718, 5,092,687, 5,120,327, 5,135,061, 5,154,245, 5,364,192, 5,368,398, 5,460,233, 5,480,233, 5,544,713, and 6,793,681. Thus, the present invention contemplates that any process encompassed herein may be employed for forming superabrasive elements/compacts (e.g., "PDC cutters" or polycrystalline diamond wear elements) for such apparatuses or the like.

Figure 12:
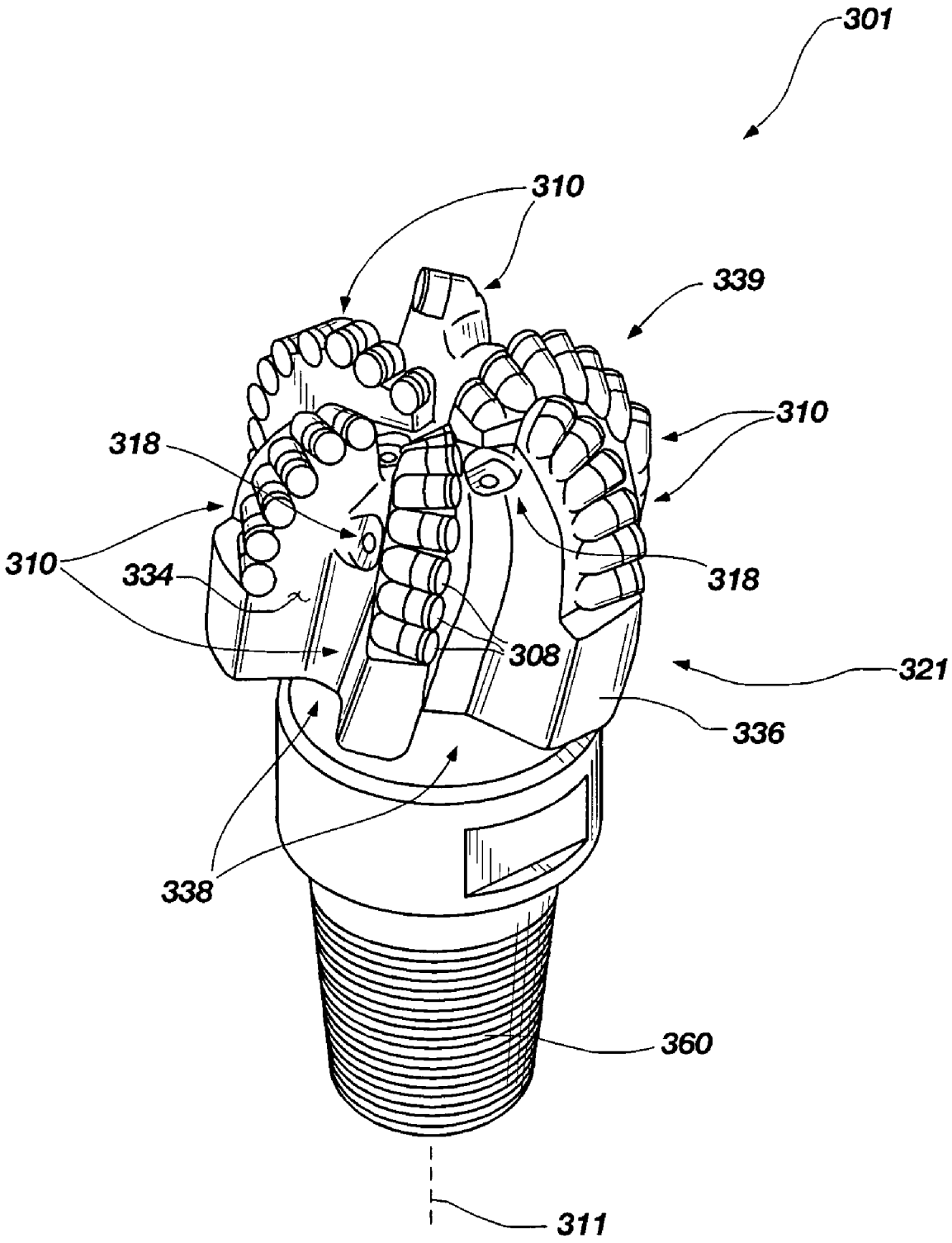
FIG. 12 shows a perspective view of a rotary drill bit including at least one superabrasive cutting element according to the present invention.
Figure 13:
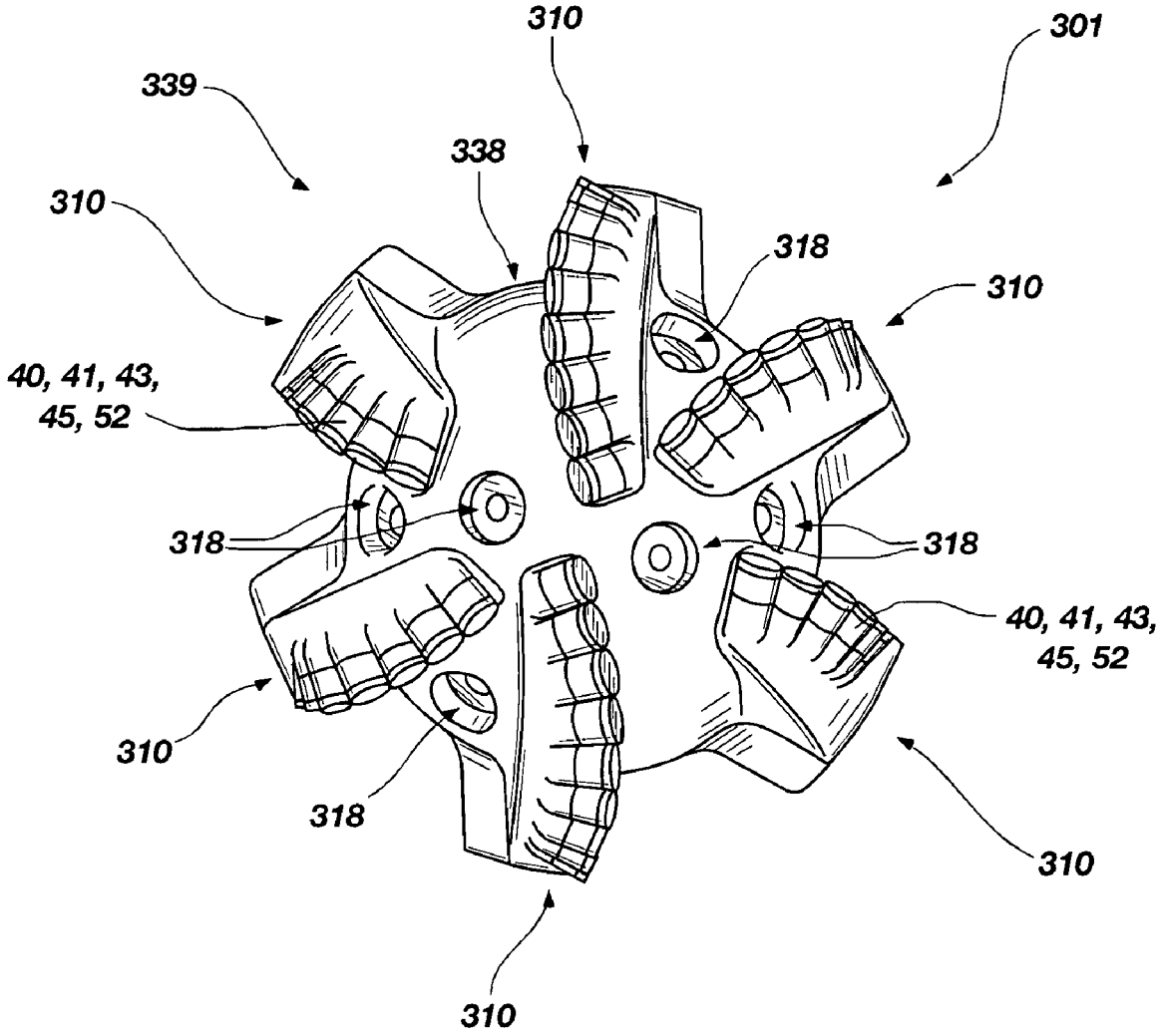
FIG. 13 shows a top elevation view of the rotary drill bit shown in FIG. 12.

As may be appreciated from the foregoing discussion, the present invention further contemplates that at least one superabrasive element/compact as described above may be affixed or coupled to a rotary drill bit for subterranean drilling. Such a configuration may provide a cutting element with enhanced properties in comparison to a conventionally formed cutting element. For example, FIGS. 12 and 13 show a perspective view and a top elevation view, respectively, of an example of an exemplary rotary drill bit 301 of the present invention including at least one superabrasive compact/element 40, 41, 43, 45, or 52 secured the bit body 321 of rotary drill bit 301 (e.g., by brazing or by any suitable affixation structure or method). Such superabrasive compact/element 40, 41, 43, 45, or 52 may be manufactured according to the above-described processes of the present invention, may exhibit structural characteristics as described above, or both.

Referring to FIGS. 12 and 13, generally, rotary drill bit 301 includes a bit body 321 which defines a leading end structure for drilling into a subterranean formation by rotation about longitudinal axis 311 and application of weight-on-bit. More particularly, rotary drill bit 301 may include radially and longitudinally extending blades 310 including leading faces 334. Further, circumferentially adjacent blades 310 define so-called junk slots 338 therebetween. As shown in FIGS. 12 and 13, rotary drill bit 301 may also include, optionally, superabrasive cutting elements 308 (e.g., generally cylindrical cutting elements such as PDC cutters) which may be a superabrasive element/compact according to the present invention or which may be conventional, without limitation. Additionally, rotary drill bit 301 includes nozzle cavities 318 for communicating drilling fluid from the interior of the rotary drill bit 301 to the superabrasive cutting elements 308, face 339, and threaded pin connection 360 for connecting the rotary drill bit 301 to a drilling string, as known in the art.

It should be understood that although rotary drill bit 301 includes at least one compact/element 40, 41, 43, 45, or 52, the present invention is not limited by such an example. Rather, a rotary drill bit according to the present invention may include, without limitation, one or more cutting elements according to the present invention. Optionally, each of the compact/element 40, 41, 43, 45, 308, or 52 shown in FIGS. 12 and 13 may be formed according to processes contemplated by the present invention. Also, it should be understood that FIGS. 12 and 13 merely depict one example of a rotary drill bit employing at least one cutting element of the present invention, without limitation. More generally, the present invention contemplates that drill bit 301 may represent any number of earth-boring tools or drilling tools, including, for example, core bits, roller-cone bits, fixed-cutter bits, eccentric bits, bicenter bits, reamers, reamer wings, or any other downhole tool including polycrystalline diamond cutting elements or inserts, without limitation.

Figure 14A:
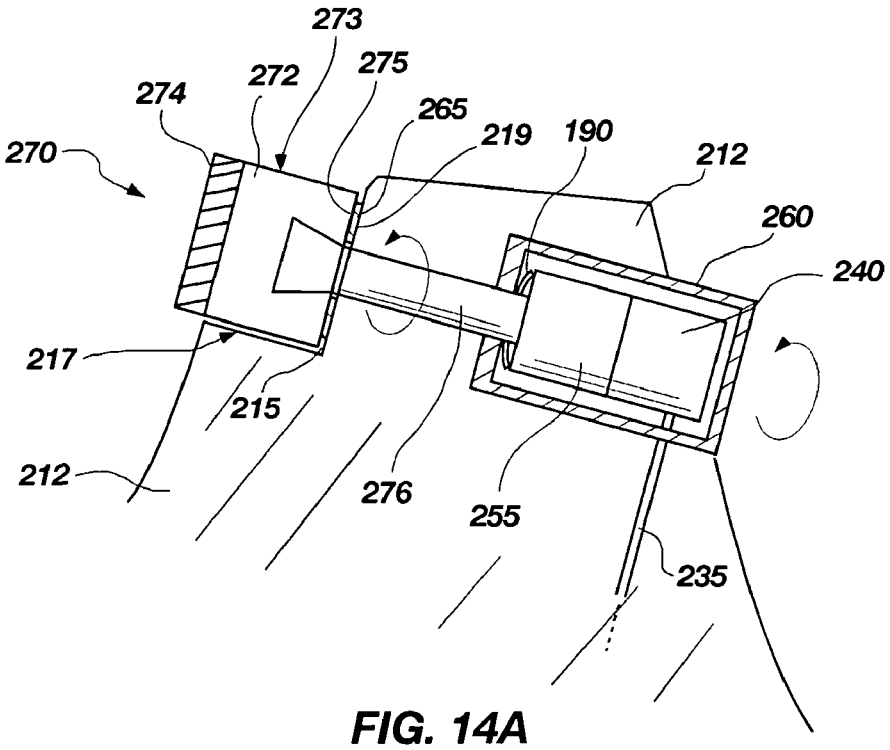
FIG. 14A shows an enlarged side cross-sectional view of one embodiment of a rotatable cutting system including a tungsten carbide layer.

The present invention further contemplates that a tungsten carbide layer may be beneficial for structures disclosed in U.S. application Ser. No. 11/247,574, entitled "Cutting element apparatuses, drill bits including same, methods of cutting, and methods of rotating a cutting element," the disclosure of which is incorporated, in its entirety, by this reference. For example, FIG. 14A shows an enlarged cross-sectional view of an embodiment of an actuator assembly 240 for applying torque to a rotatable cutting element. Actuator assembly 240 generally represents a device capable of transforming electricity or hydraulic energy generated and supplied by power source 230 into torque for rotating cutting element 270. In at least one embodiment, actuator assembly 240 comprises a motor (e.g., an electric motor or a hydraulic motor) that converts the electricity or hydraulic energy generated and supplied by power source 230 into torque. For example, FIG. 14A shows an actuator assembly 240 comprising a relatively compact motor (such as, for example, an electrically-powered geared motor or stepper motor) configured to generate and apply torque to a drive shaft 276 coupled to a substrate 272 of cutting element 270. Optionally, the torque and speed of rotation of drive shaft 276 relative to the torque and speed of rotation generated by actuator assembly 240 may be controlled by a transmission 255 coupled to actuator assembly 240. Generally, transmission 255 may represent a gearbox or other device and may be desirable for converting an unsuitably high speed and low torque generated by an actuator assembly 240 (e.g., an electrically-powered motor) to a lower speed with higher torque, or vice versa.

As shown in FIG. 14A, actuator assembly 240 may be housed within recess 260 defined within a blade 212 of a drill bit. Also, optionally, a biasing element 190 (e.g., a Belleville washer spring, a coil spring, etc.) may be positioned between the actuator assembly 240 and the bit body (e.g., bit blade 212) so that cutting element 270 is biased toward cutting pocket 215. Recess 260 may, optionally, be sealed and pressurized to protect actuator 240 from excessive exposure to drilling fluids. Cutting element 270 generally represents any form of cutting structure (e.g., a superabrasive compact/element encompassed by the present invention) capable of cutting a subterranean formation. In addition, drive shaft 276 may be mechanically coupled to substrate 272 of cutting element. Also, cutting element 270 may be rotatably mounted within a cutting pocket 215 defined in bit blade 212 of a drill bit. Cutting pocket 215 of bit blade 212 may be generally configured similar to cutting pocket 115 to surround at least a portion of a periphery of cutting element 270 when positioned within cutting pocket 215. In addition, optionally, a separation element 165 (e.g., a washer element or the like) may be positioned between front surface of cutting pocket 215 and a back surface 275 of substrate 272 of cutting element 270.

Figure 14B:
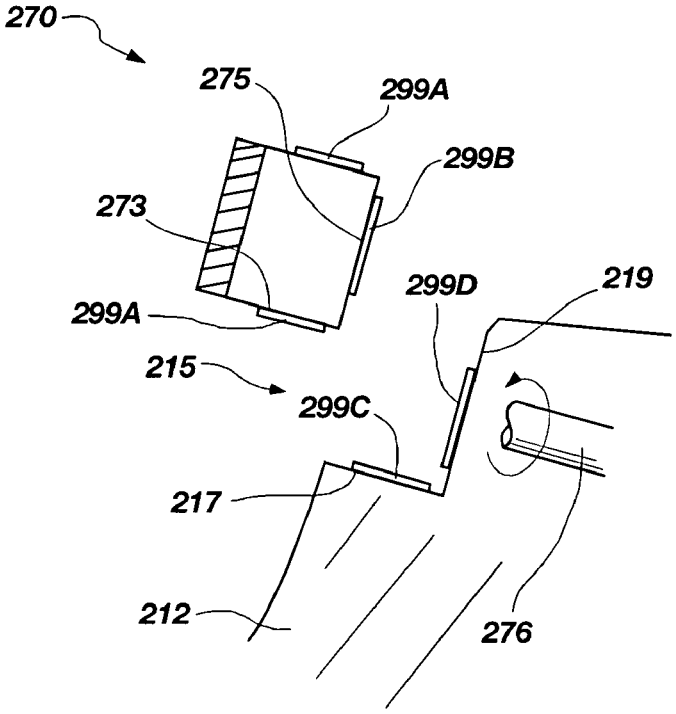
FIG. 14B shows an exploded, partial side cross-sectional view of the cutting element and cutting pocket shown in FIG. 14A.

In general, the present invention contemplates that at least one of the cutting element 270 and the cutting pocket 215 may include a tungsten carbide layer. Optionally, both of the cutting element and the cutting pocket 215 may include a tungsten carbide layer. In one embodiment, a tungsten carbide layer may be formed upon at least a portion of a side surface 273 or back surface 275 of the cutting element 270 adjacent to cutting pocket 215. More particularly, FIG. 14B shows an exploded, partial, side cross-sectional view of cutting element 215 and cutting pocket 215. As shown in FIG. 14B, cutting element 270 may include a tungsten carbide layer 299A, a tungsten carbide layer 299B, or both. One of ordinary skill in the art will understand that any portion of side surface 273, back surface 275, or both (e.g., a continuous tungsten carbide layer formed over at least a portion of side surface 273 and at least a portion of back surface 275) may include a tungsten carbide layer, without limitation. Further, as shown in FIG. 14B, cutting pocket 215 may include a tungsten carbide layer 299C, a tungsten carbide layer 299D, or both. One of ordinary skill in the art will understand that any portion of side surface 217, back surface 219, or both (e.g., a continuous tungsten carbide layer formed over at least a portion of side surface 217 and at least a portion of back surface 219) may include a tungsten carbide layer, without limitation. Such a configuration (i.e., a tungsten carbide layer formed upon at least one of: a cutting element and a cutting pocket) may inhibit wear and/or friction between the cutting element 270 and the cutting pocket 215. However, the present invention contemplates that a tungsten carbide layer formed upon at least a portion of a cutting structure, a cutting pocket, or both may be beneficial to both rotating cutting elements and non-rotating cuffing elements, without limitation.

Figure 15:
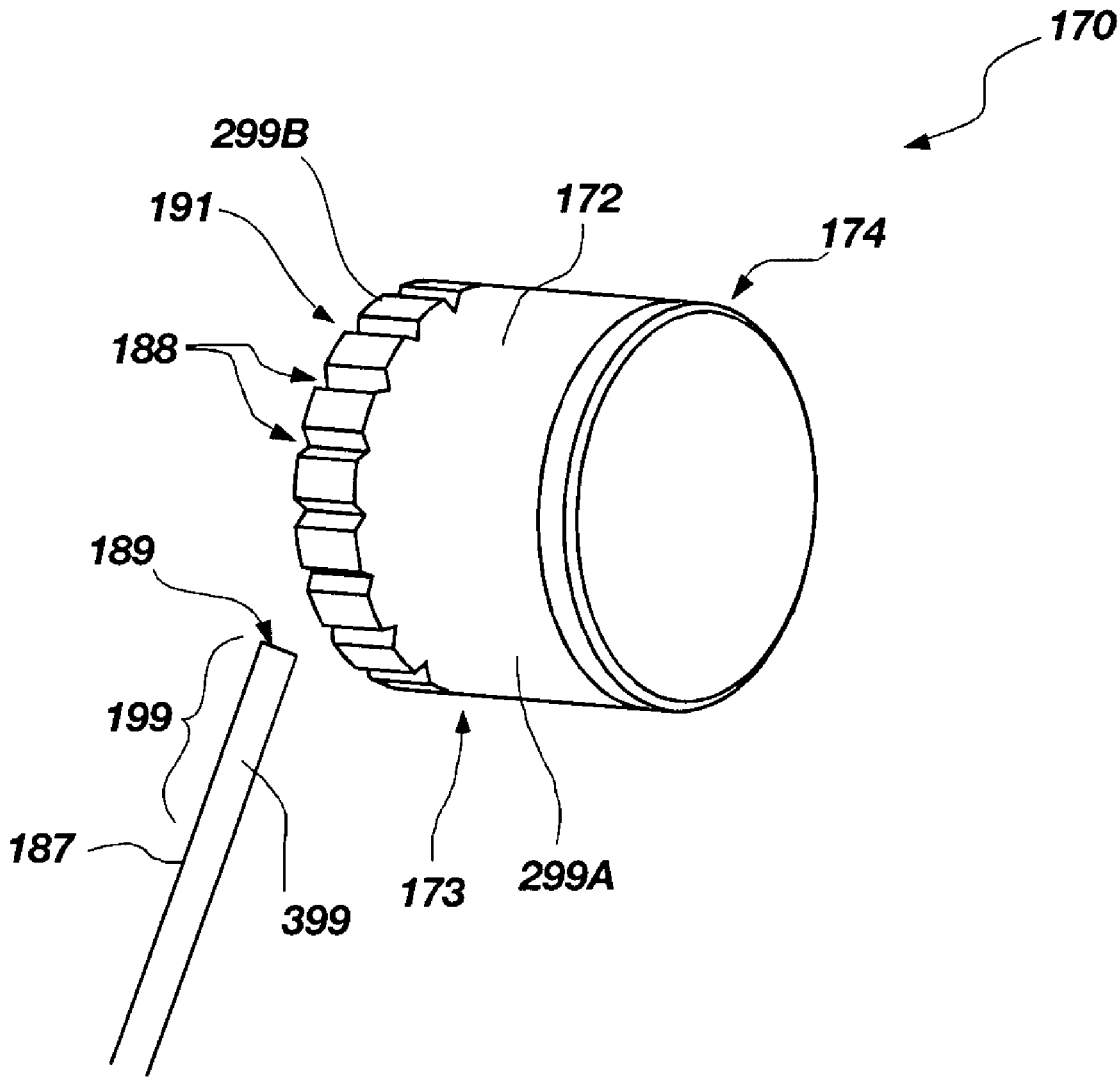
FIG. 15 shows a perspective view an embodiment of an actuator assembly for applying torque to a rotatable cutting element, wherein at least one of the components includes a tungsten carbide layer.

In another embodiment, FIG. 15 shows a push rod 187 configured for interacting with engaging features 188 formed into a substrate 172 to rotate cuffing element 170. More particularly, an end 189 of push rod 187 may be structured for interacting with engaging features 188 (e.g., a surface or other aspect of a recess) to rotate cutting element 170. Thus, it may be understood that an actuator assembly may cause push rod 187 to reciprocate (i.e., toward and away from) with respect to substrate 172. The present invention generally contemplates that at least a portion of push rod 187 and/or cutting element 170 may include a tungsten carbide layer. Particularly, in one embodiment, region 199 of push rod 187 may include a tungsten carbide layer 399. Further, as shown in FIG. 15, cutting element 170 may include a tungsten carbide layer 299A, a tungsten carbide layer 299B, or both. One of ordinary skill in the art will understand that any portion of side surface 173, back surface 175, or both (e.g., a continuous tungsten carbide layer formed over at least a portion of side surface 173 and at least a portion of back surface 175) may include a tungsten carbide layer, without limitation.

While certain embodiments and details have been included herein and in the attached invention disclosure for purposes of illustrating the invention, it will be apparent to those skilled in the art that various changes in the methods and apparatus disclosed herein may be made without departing form the scope of the invention, which is defined in the appended claims. The words "including" and "having," as used herein, including the claims, shall have the same meaning as the word "comprising."

The invention claimed is:

1. A superabrasive element configured for brazing to a bit body of a drill bit, comprising:

a superabrasive volume comprising a sintered superabrasive material, the superabrasive volume including an upper surface, a back surface, and at least one side surface extending therebetween; and a tungsten carbide layer configured to be brazed to the bit body, the tungsten carbide layer attached to the back surface and a majority of the at least one side surface of the superabrasive volume, the tungsten carbide layer being substantially free of binder material, the tungsten carbide layer exhibiting a thickness of about 5 μm to about 100 μm.

2. The superabrasive element of claim 1 wherein the tungsten carbide layer exhibits a thickness of about 5 μm to about 60 μm.

3. The superabrasive element of claim 1 wherein the tungsten carbide layer consists essentially of tungsten carbide.

4. The superabrasive element of claim 1 wherein the tungsten carbide layer comprises fluorine.

5. The superabrasive element of claim 1 wherein the sintered superabrasive material comprises one of the following:

polycrystalline diamond;

cubic boron nitride; and a diamond-silicon carbide composite.

6. The superabrasive element of claim 1 wherein the sintered superabrasive material comprises at least partially thermally-stable polycrystalline diamond.

7. The superabrasive element of claim 1, further comprising:

a braze material bonded to the tungsten carbide layer.

8. A rotary drill bit including a bit body adapted to engage a subterranean formation during drilling and at least one superabrasive cutting element mounted to the bit body, wherein the at least one superabrasive cutting element comprises the superabrasive element according to claim 1.

9. A polycrystalline diamond element configured for brazing to a bit body of a drill bit, comprising:

a polycrystalline diamond volume comprising a sintered polycrystalline diamond material, the polycrystalline diamond volume including an upper surface, a back surface, and at least one side surface extending therebetween;

a tungsten carbide layer configured to be brazed to the bit body, the tungsten carbide layer attached to the back surface and a substantial portion of the at least one side surface of the polycrystalline diamond volume, the tungsten carbide layer including fluorine but being substantially free of binder material, the tungsten carbide layer exhibiting a thickness of about 5 μm to about 100 μm.

10. The polycrystalline diamond compact of claim 9 wherein thickness of the tungsten carbide layer is about 5 μm to about 60 μm.

11. A polycrystalline diamond element configured for brazing to a bit body of a drill bit, the polycrystalline diamond element consisting essentially of:

a polycrystalline diamond volume comprising a sintered polycrystalline diamond material, the polycrystalline diamond volume including an upper surface, a back surface, and at least one side surface extending therebetween; and a chemically-vapor-deposited tungsten carbide layer configured to be brazed to the bit body, the chemically-vapor-deposited tungsten carbide layer attached to the back surface and a majority of the at least one side surface of the polycrystalline diamond volume, the chemically-vapor-deposited tungsten carbide layer including fluorine but being substantially free of binder material, the chemically-vapor-deposited tungsten carbide layer exhibiting a thickness of about 5 μm to about 100 μm.

12. A rotary drill bit, comprising:

a bit body configured to engage a subterranean formation during drilling; and a plurality of superabrasive cutting elements mounted to the bit body, at least one of the plurality of superabrasive cutting elements including:

a polycrystalline diamond volume comprising a sintered polycrystalline diamond material, the polycrystalline diamond volume including an upper surface, a back surface, and at least one side surface extending therebetween; and a chemically-vapor-deposited tungsten carbide layer attached to at least the back surface of the polycrystalline diamond volume and a majority of the at least one side surface, the chemically-vapor-deposited tungsten carbide layer attached to the bit body.

13. A polycrystalline diamond element configured for brazing to a bit body of a drill bit, the polycrystalline diamond element consisting essentially of:

a polycrystalline diamond volume comprising a sintered polycrystalline diamond material, the polycrystalline diamond volume including an upper surface, a back surface, and at least one side surface extending therebetween; and a tungsten carbide layer configured to be brazed to the bit body, the tungsten carbide layer attached to at least the back surface of the polycrystalline diamond volume, the tungsten carbide layer being substantially free of binder material, the tungsten carbide layer exhibiting a thickness of about 5 μm to about 100 μm.

14. The polycrystalline diamond element of claim 13 in which a braze material is bonded to the tungsten carbide layer.

* * * * *